US006494258B1

(12) United States Patent
Weingarten

(10) Patent No.: US 6,494,258 B1
(45) Date of Patent: Dec. 17, 2002

(54) DOWNHOLE GAS-LIQUID SEPARATOR FOR PRODUCTION WELLS

(75) Inventor: Jean S. Weingarten, McKinney, TX (US)

(73) Assignee: Phillips Petroleum Company, Bartlesville, OK (US)

( * ) Notice: Subject to any disclaimer, the term of this patent is extended or adjusted under 35 U.S.C. 154(b) by 9 days.

(21) Appl. No.: 09/864,802

(22) Filed: May 24, 2001

(51) Int. Cl.[7] ..... E21B 43/40
(52) U.S. Cl. ..... 166/265; 166/369; 166/105.5
(58) Field of Search ..... 166/265, 266, 166/369, 105.5, 169

(56) References Cited

U.S. PATENT DOCUMENTS

| | | | |
|---|---|---|---|
| 5,431,228 A | | 7/1995 | Weingarten et al. |
| 5,794,697 A | | 8/1998 | Wolflick et al. |
| 5,992,521 A | | 11/1999 | Bergen et al. |
| 6,026,901 A | | 2/2000 | Brady et al. |
| 6,035,934 A | | 3/2000 | Stevenson et al. |
| 6,189,614 B1 | | 2/2001 | Brady et al. |
| 6,209,641 B1 | | 4/2001 | Stevenson |
| 6,260,619 B1 | * | 7/2001 | Svedeman et al. ..... 166/265 |

OTHER PUBLICATIONS

"New Design for Compact Liquid–Gas Separation", J. S. Weingarten et al SPE 30637 , Dallas TX, Oct. 22–25, 1995.

* cited by examiner

*Primary Examiner*—William Neuder
(74) *Attorney, Agent, or Firm*—Drude Faulconer

(57) ABSTRACT

A method and system for producing a mixed gas-oil stream wherein at least a portion of the gas is separated downhole by an auger separator which is comprised of an upstream and a downstream section. As the mixed stream flows through a converging passageway in the upstream section and gas is separated by an auger, the velocity of the stream is increased thereby reducing the temperature and pressure of the stream. This allows more of the condensate to remain with the liquids and not be separated with the gas. The liquids exit the upstream section and are produced to the surface. The separated gas flows through a diverging passageway in the downstream section where a port ion of the reduced pressure is regained before the gas either produced to the surface or compressed for downhole injection.

10 Claims, 2 Drawing Sheets

FIG. 1
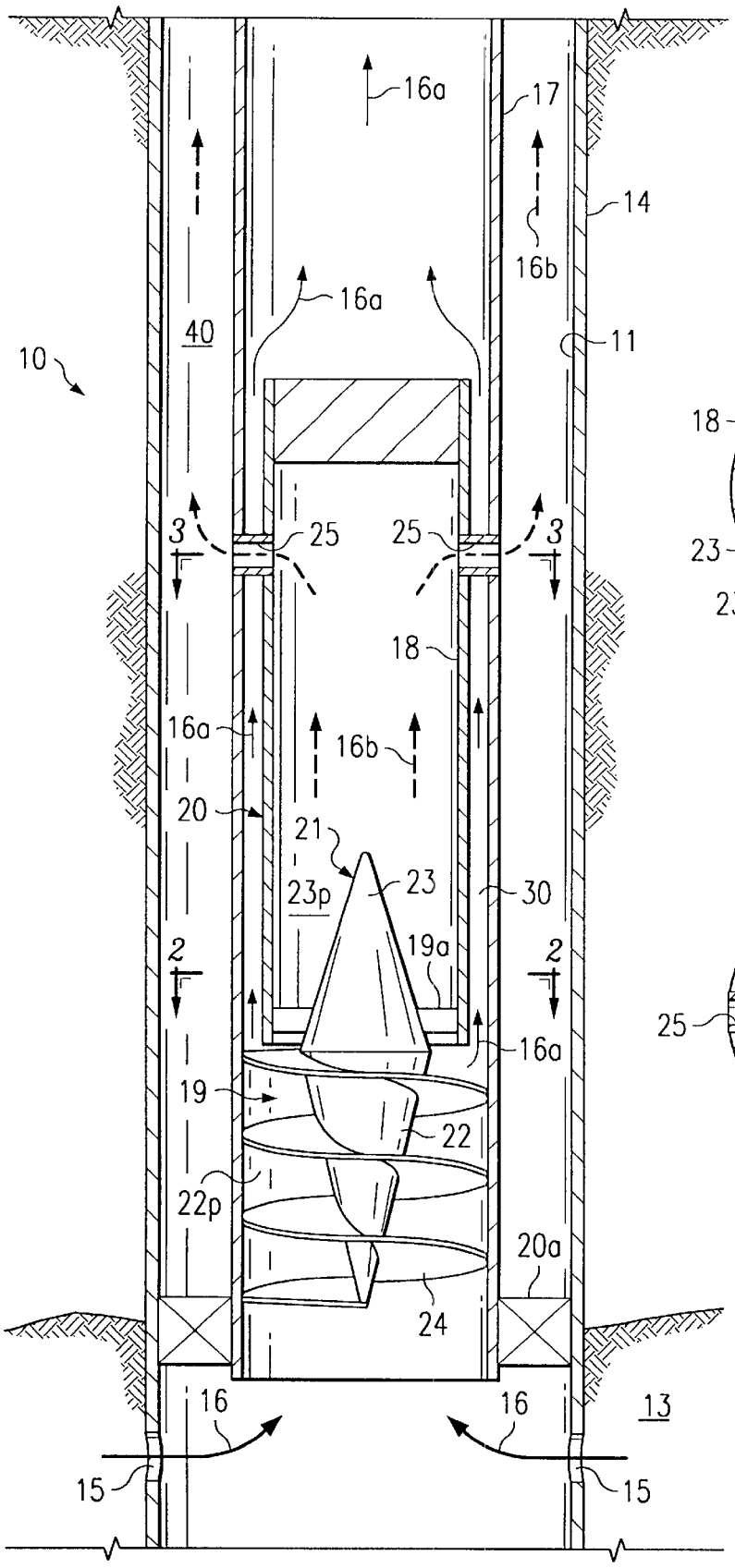
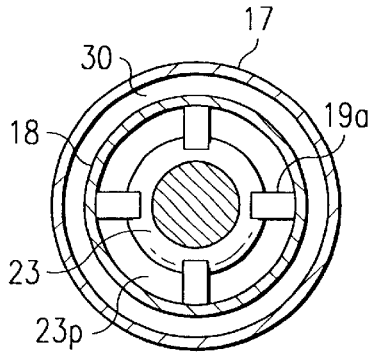
FIG. 2
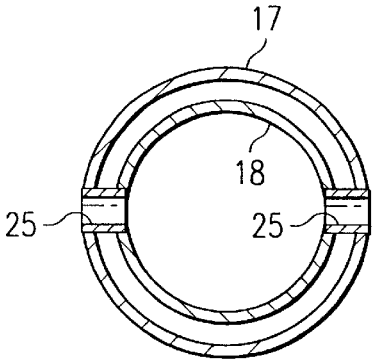
FIG. 3

DOWNHOLE GAS-LIQUID SEPARATOR FOR PRODUCTION WELLS

TECHNICAL FIELD

The present invention relates to the downhole separation of gas and liquid from an oil-gas production stream and in one aspect relates to separating a portion of the gas from a gas-oil production stream downhole in a wellbore while recovering increased amounts of valuable condensate to the surface along with the liquids in the remaining production stream.

BACKGROUND

It is well known that in many oil wells, extremely large volumes of gas are produced along with the crude oil and other formation fluids, e.g. water. In such wells, it is not unusual to experience gas-to-oil ratios (GOR) as high as 20,000 standard cubic feet per barrel (scf/bbl.) or greater. Since the gas and oil are commingled and are produced to the surface as a single production stream, large and expensive equipment is required at the surface to separate this gas from the liquids in the production stream before either can be further processed and/or sent on to market. In fact, the amount of gas in some production streams may be so large that the available surface equipment can not handle the load and production may have to be cut back or the well shut-in at significant expense.

To reduce the size of the equipment and the related costs normally involved in separating such large volumes of gas from a production stream, various methods and systems have now been proposed wherein some of the separating/handling steps normally required at the surface are carried out downhole before the production stream is brought to the surface. These methods all basically involve separating at least a portion of the gas from the production stream downhole and then handling the separated gas and the remainder of the production stream (i.e. liquids) separately.

For example, one such method involves the positioning an "auger" separator downhole within a production wellbore which separates a portion of the gas from the production stream as the stream flows upward through the auger separator; see U.S. Pat. No. 5,431,228, issued Jul. 11, 1998. Both the remainder of the production stream and the separated gas are flowed to the surface through separate flowpaths where each is individually handled.

This type of auger separator now form an integral part of several different downhole gas-separation systems which are sometimes called "Subsurface Processing And Reinjection Compressor systems" or "SPARC". For example, in one such system, an auger separator is used to separate at least a portion of the gas from the production stream which, in turn, is then recompressed downhole and injected into a subterranean formation without ever producing the separated gas to the surface; see U.S. Pat. No. 5,794,697, issued Aug. 18, 1998. Another SPARC system utilizing an auger separator is disclosed in U.S. Pat. No. 6,189,614, issued Feb. 20, 2001 when a SPARC separates and compresses a portion of the gas in the production stream basically in the same manner as described above, but instead of re-injecting the compressed gas, both the compressed gas and the remainder of the production stream are produced to the surface through separate flowpaths.

While such downhole auger separators can separate relatively large volumes of gas from a production stream, unfortunately, they may also separate with the gas, a substantial amount of any condensate (i.e. volatile liquids) which may be present in the production stream. As will be understood in this art, it is much more desirable to recover this valuable condensate as part of the liquid stream rather than "lose" it into the separated gas stream. As used herein, "liquid stream" is intended to mean the production stream which remains after the separated gas has been removed.

Recently, a downhole SPARC system has been proposed which is adapted to increase the amount of condensate which can be recovered with the liquid stream; see commonly-assigned U.S. patent application Ser. No. 09/351,483, filed Jul. 13, 1999 and now U.S. Pat. No. 6,260,619 B1, issued Jul. 17, 2001. In this system, the amount of recovered condensate is increased by flowing both the separated gas stream and the liquid streams through a restrictive passage after they pass through the auger separator and before the gas is flowed into a downhole compressor.

In downhole gas separation systems such as those discussed above, the auger separator, itself, is basically designed to separate as much gas from the production stream as is practical in a given situation without any real concern being given to the amount of condensate which is also separated with the gas. Again, it will be understood that it is much more desirable from an economic standpoint to retain as much of the condensate as possible in the liquid stream as the production stream passes through the downhole auger separator.

SUMMARY OF THE INVENTION

The present invention provides a method and system for producing a mixed gas-oil stream to the surface from a production zone through a wellbore wherein at least a portion of said gas is separated from said mixed gas-oil stream downhole while the amount of condensate in the remaining gas-oil stream is increased over what it normally would be. Basically, at least a portion of the gas is separated from the mixed gas-oil stream downhole as the mixed stream flows upward through a converging restrictive passage within a separator which is positioned in the wellbore.

As the stream flows through the restrictive passage in the separator, the velocity of the gas-oil stream is increased which, in turn, reduces the temperature and pressure of the gas-oil stream to thereby increase the amount of condensate which will remain in the liquid or remaining mixed gas-oil stream. The separator is mounted at the lower end of a tubing string wherein the liquid stream is produced to the surface through the tubing. The separated gas stream is then flowed through a diverging passageway in the separator to thereby recover at least a portion of the pressure lost when the gas was separated within the restrictive passageway within said separator and is either produced to the surface through the well annulus or is fed to the compressor of a SPARC unit for injection in a downhole zone.

More specifically, the present invention provides a system for producing a mixed gas-oil stream from a production zone to the surface through a wellbore wherein the system comprises a string of tubing which is positioned within the wellbore wherein an annulus is formed between said tubing and said wellbore. The tubing string carries an auger separator at its lower end which is adapted to separate at least a portion of the gas from the remainder of the gas-oil stream downhole as the gas-oil stream flows upward through the wellbore.

The auger separator has a housing which is mounted in the tubing whereby an annular passage is formed between the housing and the tubing. An auger is mounted in the housing and has an upstream section and a downstream section. The upstream section has a tapered core (e.g. conical-shaped) whose diameter increases upwardly from the bottom towards the top thereof whereby the passageway formed between the core of the upstream section and the wellbore converge upwardly throughout the upstream section. An auger flight is secured to and along the core of the upstream section and extends outward substantially to the wall of the tubing.

The downstream section of said separator is adapted to be secured in the lower end of the tubing string and has a tapered core (e.g. conical-shaped) whose diameter decreases upwardly from the bottom towards the top thereof whereby the passageway formed between the core of the downstream section and the tubing diverge upwardly throughout the upstream section In operation, the mixed gas-oil stream flows upward through the converging passageway in the upstream section of the downhole separator where the auger causes the mixed stream to rotate with the heavier liquid components moving outward while gas remains near the core of the separator. Flow through the converging or restrictive passageway in the upstream section increases the velocity, hence lowers the temperature and pressure, of the stream. By reducing the temperature and pressure of the stream, more of the desired condensate in the mixed stream remains in the liquid stream which is forced outwardly from the gas stream by the centrifugal forces imparted by the auger separator. The liquid stream is then produced to the surface through the tubing string. Where the downhole system includes a SPARC unit, the liquid stream flows through the turbine section thereof to thereby drive the turbine which, in turn, rotates the compressor of the unit.

The separated gas flows upward through the diverging passageway formed between the tapered core of the downstream section and the tubing string where the gas regains at least a portion of the pressure lost during flow through the converging passageway in the upstream section of the separator. The separated gas is then either produced to the surface through the well annulus or is fed into the compressor of the SPARC unit, if present, where it is compressed for injection into a downhole zone.

BRIEF DESCRIPTION OF THE DRAWINGS

The actual construction, operation, and apparent advantages of the present invention will be better understood by referring to the drawings which are not necessarily to scale and in which like numerals refer to like parts and in which:

FIG. 1 is a sectional view of the downhole auger separator of the present invention when in an operable position within a production wellbore;

FIG. 2 is a cross-sectional view of the auger separator taken within line 2—2 of FIG. 1;

FIG. 3 is a cross-sectional view of the auger separator taken within line 3—3 of FIG. 1.

Figure 4:
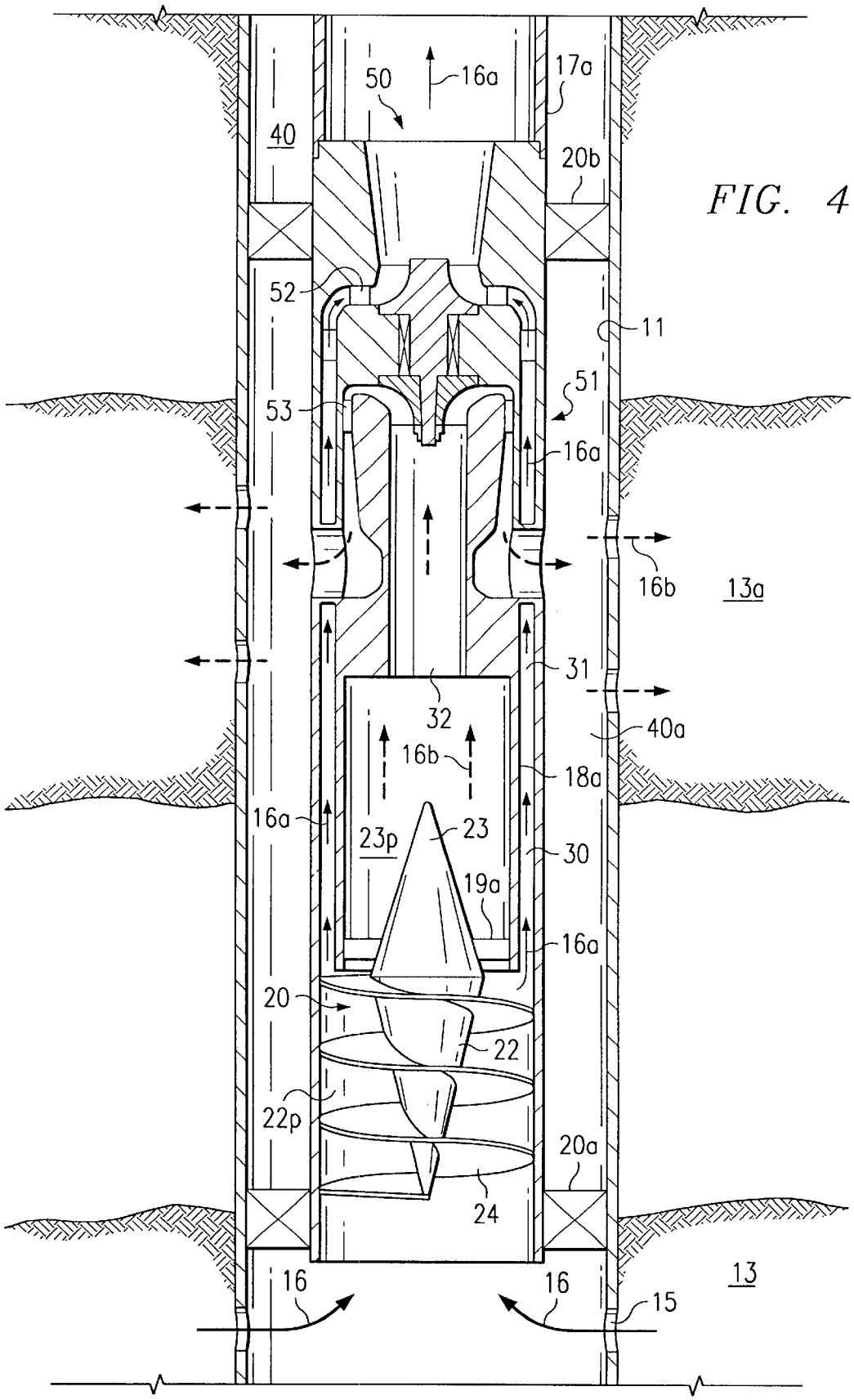
FIG. 4 is a sectional view of a SPARC system in which the auger separator of the present invention is incorporated.

While the invention will be described in connection with its preferred embodiments, it will be understood that this invention is not limited thereto. On the contrary, the invention is intended to cover all alternatives, modifications, and equivalents which may be included within the spirit and scope of the invention, as defined by the appended claims.

BEST KNOWN MODE FOR CARRYING OUT THE INVENTION

Referring more particularly to the drawings, FIG. 1 discloses a downhole section of production well 10 having a wellbore 11 which extends from the surface (not shown) into and/or through a production zone 13. As illustrated in FIG. 1, wellbore 11 is cased with a string of casing 14 which is perforated with perfs 15 or otherwise completed (e.g. open hole) adjacent the production zone 13 to allow flow of fluids (i.e. production stream, arrows 16) from the production zone into the wellbore as will be fully understood by those skilled in the art.

As shown, the downhole auger separator 20 of the present invention is assembled within the lower end of a string of production tubing 17 and lowered therewith into the wellbore 11 to a position above production formation 13 wherein a well annulus 40 is formed between the tubing 17 and casing 14. Auger separator 20, as shown, is comprised of a housing 18 having an auger 19 mounted to the lower end thereof by any appropriate means (e.g. "spider" or centralizer having a plurality of legs 19a which center auger 19 within housing 18). Also, as will be understood in the art, in some instances, auger separator 20 could be lowered down the production tubing 14 by a wireline, coiled tubing string, etc. after the production tubing has been run into the wellbore 11 and seated within a landing sub or the like (not shown) within the lower end of tubing 17. Cross-over ports 25 fluidly connect the inside of housing 18 to annulus 40 for a purpose described later. Further, as understood in the art, a tubing packer 20*a* or the like is set to block flow from formation 13 into well annulus 40.

Auger 19 is comprised of a central element or core 21 which, in turn, is comprised of two distinct conical or tapered sections; i.e. downstream or lower section 22 and downstream or upper section 23. These sections may be joined directly together (as shown) or they may be spaced a short distance from each other and joined by an intermediate section (not shown). The upstream section 22 tapers outwardly (i.e. diameter of section 22 increases) from the bottom of core 21 to approximately the midpoint of core 21 where upstream section 22 meets and becomes downstream section 23 which, in turn, tapers inwardly (i.e. diameter of section 23 decreases) from approximately the midpoint of core 21 to the top of the core. It can be seen that the passageway 22*p* surrounding upstream section 22 converges as it approaches the midpoint of core 21 while the passage 23*p* surrounding downstream section 23 diverges as it moves away from the midpoint of core 21, the purpose of which will be explained below.

A helical-wound, auger-like flight 24 is secured to and along upstream section 22 and extends outwardly from the core 21 substantially across the diameter of tubing 18. Auger separators of this type are well known in the art and are disclosed and fully discussed in U.S. Pat. No. 5,431,228 which issued Jul. 11, 1995, and which is incorporated herein in its entirety by reference. Also, for a further discussion of the construction and operation of such separators, see "New Design for Compact-Liquid Gas Partial Separation: Down Hole and Surface Installations for Artificial Lift Applications", Jean S. Weingarten et al, SPE 30637, Presented Oct. 22–25, 1995 at Dallas, Tex.

In operation, a mixed gas-oil, production stream 16 flows from production zone 13 into casing 14 and flows upward therethrough. As will be understood in the art, most mixed oil-gas streams will also include some produced water so as used herein, "production stream" is intended also to include streams having some produced water therein.

As the production stream 16 flows upward through the upstream section 22 of separator 20, auger flight 24 will impart a spin on the stream wherein the liquids (e.g. oil, water, etc., arrows 16*a*) in the stream are forced to the outside of the auger by centrifugal force while at least a portion of the gas (arrows 16*b*) is separated from the stream and remains near the wall of core 21. Due to the taper of upstream section 22, the flow passage 22*p* surrounding section 22 converges and becomes more restrictive as it approaches the midpoint of core 21.

Due to converging passage 22*p*, the velocity of both the separated gas stream and the remaining production (i.e. gas-oil) stream increase as they flow through this restrictive passage. This increased velocity causes a reduction in both the static pressure and the temperature of these streams due to the conservation of energy. The colder temperature and lower pressure of the gas stream result in larger amounts of any condensate in the production stream condensing and remaining in the mixed gas-oil stream 16*a*. As stream 16*a* with the increased condensate therein reaches the end of upstream section 22, it flows into annular passage 30, which is formed between housing 18 and production tubing 17, and is produced through tubing 17 to the surface.

As the separated gas stream 16*b* flows from the top of upstream section 22 and into downstream section 23, it enters and flows upward through the diverging passageway 23*p* which surrounds downstream section 23. Passage 23*p* functions as a diffuser passage which is designed to recover a substantial portion (e.g. from about 50% to about 70%) of the pressure that was lost by the production stream when it passed through the restrictive passage 22*p* surrounding the upstream portion 22. The separated gas 16*b* then flows through cross-over ports 25 into well annulus 40 through which it can produced to the surface.

FIG. 4 illustrates a SPARC system 50 which includes the auger separator 20 of the present invention. The auger separator 20 is constructed and operates basically the same as described above. In the embodiment of FIG. 4, a turbine-compressor unit 51 is secured to the top of housing 18*a*. Unit 51 is basically comprised of a turbine 52 and a compressor 53. The mixed gas-oil stream 16*a* with additional condensates therein flows from auger 19, through annular passage 30, and directly into the inlet 31 of turbine 52. As the stream 16*a* passes through turbine, it drives the turbine which, in turn, rotates compressor 53.

The separated gas stream 16*b* flows from auger 19 upward through housing 18*a* and into the inlet 32 of compressor 53 which, in turn, compresses the gas before passing it into annulus 40*a*. As shown, packers 20*a*, 20*b* isolate a section of well annulus 40 adjacent an injection zone (e.g. gas cap 13) which lies along the wellbore 11. As will be understood in the art, casing 14 is perforated with perfs 14*a* so that the compressed gas 16*b* can be injected into zone 13*a*. SPARC systems, such as that described, are known in the art; for example see U.S. Pat. Nos. 5,794,697 and 6,189,614, both of which are incorporated in their entireties by references.

The downhole auger separator 20 of the present invention, whether used separately or in combination with a SPARC system will increase the amount of condensate which can be recovered with the liquids from a production stream and, at the same time, recover at least a portion of the pressure lost by the separated gas stream as it was being separated from the production stream.

What is claimed is:

1. A system for producing a mixed gas-oil stream from a production zone to the surface through a wellbore said system comprising:

a string of tubing positioned within said wellbore and extending from said production zone to said surface wherein an annulus is formed between said tubing and said wellbore;

a separator positioned downhole within said wellbore and adapted to separate at least a portion of said gas from the remainder of said gas-oil stream as said gas-oil stream flows upward through said wellbore, said separator having an upstream section and a downstream section, said upstream section comprising:

a tapered lower core having a diameter which increases upwardly from the bottom thereof whereby the passageway formed between said tapered lower core and said wellbore converges upwardly throughout said upstream section; and an auger secured to and along substantially the entire length of said tapered lower core of said upstream section of said separator, said auger extending outward from said tapered lower core substantially across said tubing string.

2. The system of claim 1 wherein said downstream section of said separator comprises:

a tapered upper core positioned and secured within the lower end of said tubing string, said tapered upper core having a diameter which decreases upwardly from the bottom thereof whereby the passageway from between said upper core and said tubing string diverges upwardly throughout said downstream section.

3. The system of claim 2 wherein said at least a portion of said gas separated from the remainder of said gas-oil stream is produced to the surface through said tubing string and said remainder of said gas-oil stream is produced through said annulus.

4. The system of claim 2 including:

a turbine-compressor unit positioned within said tubing string above said separator wherein said the gas separated from said gas-oil stream is passed through said compressor and said remainder of said gas-oil stream is passed through said turbine.

5. A system for producing a mixed gas-oil stream from a production zone to the surface through a wellbore said system comprising:

a string of tubing positioned within said wellbore and extending from said production zone to said surface wherein a well annulus is formed between said tubing and said wellbore;

a separator positioned downhole within said wellbore and adapted to separate at least a portion of said gas from the remainder of said gas-oil stream as said gas-oil stream flows upward through said wellbore, said separator comprising:

a housing mounted in the lower end of said tubing and forming an annular passage therebetween;

an auger secured within said housing and extending from the lower end thereof, said auger having an upstream section and a downstream section, said upstream section comprising:

a tapered lower core having a diameter which increases upwardly from the bottom thereof whereby the passageway formed between said tapered lower core and said wellbore converges upwardly throughout said upstream section; and an auger flight secured to and along substantially the entire length of said tapered lower core of said upstream section of said separator, said auger extending outward from said tapered lower core substantially across said tubing string.

6. The system of claim 5 wherein said downstream section of said separator comprises:

a tapered upper core connected to said upstream section and positioned within and secured within the lower end of said tubing string, said tapered upper core having a diameter which decreases upwardly from the bottom thereof whereby the passageway from between said upper core and said tubing string diverges upwardly throughout said downstream section.

7. The system of claim 6 wherein said at least a portion of said gas separated from the remainder of said gas-oil stream is produced to the surface through said well annulus and said remainder of said gas-oil stream is produced through said tubing.

8. The system of claim 6 including:

a gas compression unit positioned within said tubing string above said separator, said unit comprising:

a compressor, a turbine for rotating said compressor and wherein said the gas separated from said gas-oil stream is passed through said compressor and said remainder of said gas-oil stream is passed through said turbine.

9. An auger separator for separating at least a portion of the gas in a gas-oil production stream, said auger separator comprising:

an upstream section, said upstream section comprising:

a tapered lower core having a diameter which increases upwardly from the bottom thereof towards the top thereof; and an auger secured to and along substantially the entire length of said tapered lower core of said upstream section; and a downstream section, said downstream section comprising:

a tapered upper core having a bottom attached to said top of said upstream section, said tapered upper core having a diameter which decreases upwardly from said bottom thereof towards the top thereof.

10. The auger separator of claim 9 wherein said tapered core of said upstream section and said tapered core of said downstream section are substantially conical-shaped.

* * * * *